United States Patent [19]

Carnwath

[11] Patent Number: 4,896,624

[45] Date of Patent: Jan. 30, 1990

[54] MAIL BOX SIGNAL APPARATUS

[76] Inventor: James R. Carnwath, 12024 86th Ave. N.W., Kirkland, Wash. 98034

[21] Appl. No.: 326,974

[22] Filed: Mar. 22, 1989

[51] Int. Cl.[4] ..... G09F 17/00; B65D 91/00

[52] U.S. Cl. ..... 116/303; 232/35; 292/204

[58] Field of Search ..... 116/173, 175, 303; 232/34, 35, 37; 292/101, 103, 178, 204, 300, 303

[56] References Cited

U.S. PATENT DOCUMENTS

| | | | |
|---|---|---|---|
| 380,899 | 4/1888 | Jones | 116/303 |
| 1,458,836 | 6/1923 | McDowell | 232/35 |
| 3,338,511 | 8/1967 | Cvar | 232/35 |
| 3,482,543 | 12/1969 | Guidos | 232/35 |
| 3,516,383 | 6/1970 | Goodman | 232/35 |
| 4,491,268 | 1/1985 | Faulkingham | 232/35 |

*Primary Examiner*—William A. Cuchlinski, Jr.

*Assistant Examiner*—W. Morris Worth

*Attorney, Agent, or Firm*—Robert W. Jenny

[57] ABSTRACT

The apparatus comprises a hook and a spring having an elongated arm portion. The spring is attached to the top of a conventional roadside mailbox with the arm parallel to the longitudinal centerline of the mailbox and with its end extending a short distance beyond the door at the end of the mailbox. The hook is attached to the door so that it can engage the end of the arm when the door is closed. The spring is such that when the door is opened and the hook is thereby moved to discharge from the end of the arm, the arm springs upward and comes to rest at a position up and away from the top of the mailbox, indicating that the door has been opened. The positions of the arm are made more clearly visible by tufts, tassels or the like attached to the arm near the end engaged by the hook. After the door is re-closed, the arm is manually reengaged with the hook.

1 Claim, 2 Drawing Sheets

MAIL BOX SIGNAL APPARATUS

BACKGROUND OF THE INVENTION

1. Field

The subject apparatus is in the field of signalling devices in which the position of an element has significance. Signal flags as used for intership communication and semaphore apparatus for railroads are typical examples. More specifically it is in the field of such apparatus adapted to indicate from a distance whether or not mail has been deposited in a mail box.

2. Prior Art

There is much prior art in this specific field, patented or commercially available or both, so much in fact that no specific examples are cited herein. Also, the subject concept was not conceived to overcome the shortcomings in any one or several examples of prior art. Instead, it was conceived to overcome what are considered to have been the primary inhibitors of more widespread use of such devices, expense and complication of use. Accordingly the objective of the subject invention is to provide apparatus for signalling whether or not mail has been deposited in a mail box, the apparatus being available at minimum cost and being ultimately simple to install and use.

SUMMARY OF THE INVENTION

The apparatus is intended for use on standard roadside mail boxes comprising a housing having a door at one end, that end being positioned toward the road, and the door being hinged at its bottom edge with one result being that when the door is opened to allow depositing mail in the box, the top end of the door arcs first away from the box and then downward. The subject apparatus comprises a spring, two fasteners, a clip, a highly visible tuft or other signal material and a hook. The spring is approximately as long as the mail box and is attached to the top of the box and, in its engaged position, extends along the top of the box in a plane parallel to the longitudinal axis of the box to project a distance beyond the door end of the box and over the top end of the door when the door is closed. The hook is attached to the door and extends up and over the end of the spring when the door is closed. The spring is such that the end of the spring thus engaged by the hook will spring upward from the top of the box to the free position of the arm segment when the door is opened and the hook is thereby slipped off the free end of the spring. The tuft is attached to the spring near the free end so that release of the spring by opening of the door to deposit mail is clearly indicated by the fact that the tuft is lifted up and away from the mail box. In the optimum embodiment the tuft or the like is visible equally from all points. When the deposited mail is retrieved the apparatus is reset by closing the mailbox door and resetting the free end of the spring arm under the hook.

The invention is described in more detail below with reference to the attached drawings.

BRIEF DESCRIPTION OF THE DRAWINGS

FIG. is a perspective view of the spring used in the subject invention.

DETAILED DESCRIPTION OF THE INVENTION

The invention is an apparatus for signalling that the door of a mailbox has been opened and therefore that, under normal circumstances, mail has been put in the box. The apparatus comprises a spring, a hook, a clip, a tuft or the like and two fasteners.

Figure 1:
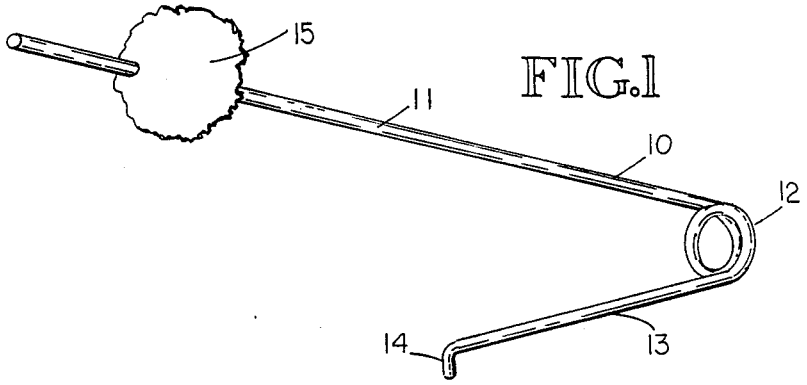

The spring 10, as shown in FIG. 1, is one piece and made of spring wire and comprises an arm segment 11, a coil segment 12, a base segment 13 and tip segment 14. The segments lie essentially in a flat plane. Tuft or other signal material 15 is fastened to the arm segment a short distance from free end 16 of the arm segment.

Figure 2:
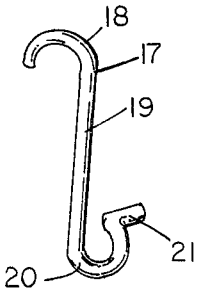
FIG. 2 is a perspective view of the hook.

The hook 17, shown in FIG. 2, is also one piece and made of spring wire and comprises hook segment 18, shank segment 19, eye segment 20 and tip segment 21. The hook shank and eye segments lie essentially in a flat plane and the tip segment is normal to that plane.

Figure 3:
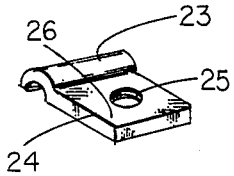
FIG. 3 is a perspective view of the clip.

Clip 22, shown in FIG. 3, comprises arced segment 23 and flat segment 24. Hole 25 is centered in the broad face 26 of the flat segment.

Figure 4:
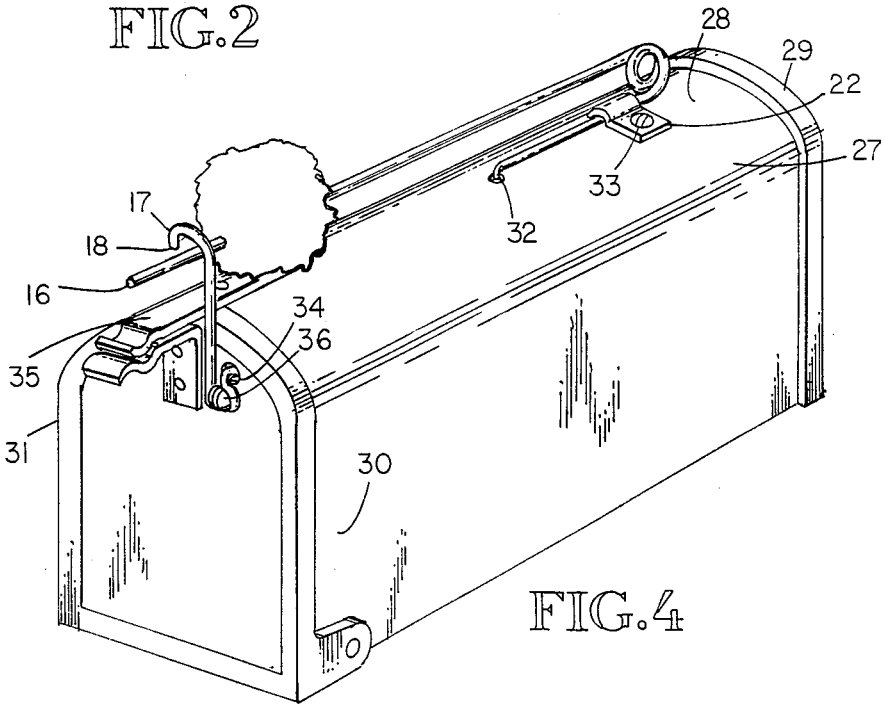
FIG. 4 is a perspective view of a mail box equipped with the invention with the spring engaged by the hook.

FIG. 4 illustrates the apparatus installed on a conventional mailbox 27 having a longitudinal axis, a top 28, a closed end 29, a door end 30 and a door 31. In this illustration the spring is in its engaged position. The first step in attaching the spring to the top of the mail box is making a hole 32 at a point along the top located so that, when tip segment 14 is engaged in the hole, free end 16 extends far enough past the plane of the door to be able to engage hook 17. Then clip 22 is positioned with its arced segment over the base segment of the spring near the coil segment and a hole is made in alignment with the hole in the clip. Fastener 33 is then installed in the hole to hold the clip and the spring in place. The fastener may be a sheet metal screw, pop rivet, machine screw and nut or the like.

The hook is attached to the door by first making a hole 34 in the door to receive tip segment of the hook and located so that when the shank segment is essentially vertical there is enough clearance between hook segment 18 and latch apparatus 35 to allow the arm segment of the spring to be moved under and engaged by the hook. A second hole is then made in the door in alignment with the eye segment of the hook and a second fastener 36 is used to hold the hook in place. This fastener also may be a sheet metal screw, pop rivet, machine screw and nut or the like.

Figure 5:
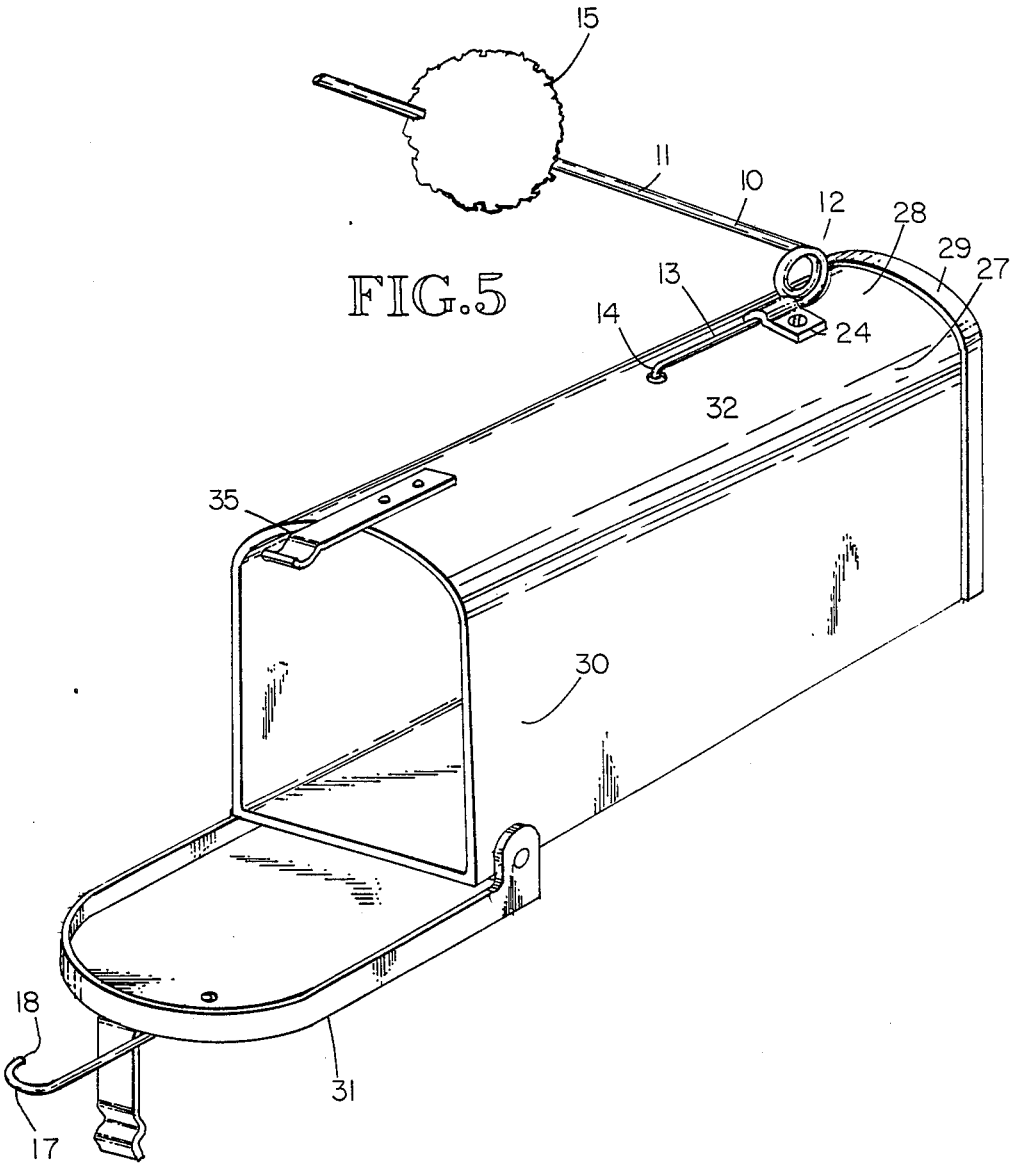
FIG. 5 is a perspective view of a mail box equipped with the invention with the door open and the spring disengaged to signal that the door has been opened.

In FIG. 5 the door has been opened, moving the hook off the arm segment, allowing the arm segment to spring upward into its free position. The upward, free position of the arm segment thus indicates that the door has been opened, usually so that mail can be placed in the mailbox, and therefore further indicating that mail is in the box.

When the mail is removed, the door is closed and the arm segment manually reengaged with the hook, thus resetting the apparatus for a sequential operation.

It is considered understandable from this description that the subject invention provides minimum costs ultimately simple apparatus for signalling whether or not mail has been deposited in a mailbox, the apparatus being both simple to make and use.

It is considered understandable also that, while one embodiment of the invention is described herein, other embodiments and modifications of the one described are possible within the scope of the invention which is limited only by the attached claims.

What is claimed:

1. Signal apparatus for use on a mailbox, said mailbox having a longitudinal axis, a top, an open end and a door at said open end, said door having a bottom edge and a top end and being hinged to said mailbox at said bottom edge so that when said door is opened said top end moves away from said top of said mailbox, said apparatus comprising:

a one piece spring having a base segment, a coil segment and an arm segment, said arm segment having a free end and a free position and an engaged position, said engaged position being essentially parallel to said top and said free position being at an angle to said top, a hook having an eye segment, a shank segment and a hook segment, a clip, a first fastener, a second fastener and signal material, said signal material being attached to said arm segment near said free end, said base segment of said spring being attached to said top of said mail box with said clip and said first fastener with said arm segment in a plane parallel to said longitudinal axis and said free end extending past said top end of said door, said hook being attached to said door with said second fastener and located so that said hook segment can engage said free end of said arm segment, whereby when said door is closed said free end of said arm segment can be engaged by said hook segment to hold said arm segment in said engaged position and when said door is opened said hook segment disengages from said free end and said arm segment moves to said free position.

* * * * *